US007802882B2

(12) United States Patent
Haba

(10) Patent No.: US 7,802,882 B2
(45) Date of Patent: Sep. 28, 2010

(54) PRINTING APPARATUS, TARGET TRANSPORT DEVICE, AND TARGET TRANSPORT METHOD

(75) Inventor: Shinji Haba, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/410,186

(22) Filed: Mar. 24, 2009

(65) Prior Publication Data

US 2009/0244232 A1 Oct. 1, 2009

(30) Foreign Application Priority Data

Mar. 25, 2008 (JP) ..... 2008-078858

(51) Int. Cl.
*B41J 2/01* (2006.01)

(52) U.S. Cl. ..... 347/102; 347/104

(58) Field of Classification Search ..... 347/4, 347/102

See application file for complete search history.

(56) References Cited

U.S. PATENT DOCUMENTS

| | | | | |
|---|---|---|---|---|
| 5,512,924 | A * | 4/1996 | Takada et al. | 347/18 |
| 2002/0071016 | A1 * | 6/2002 | Wotton et al. | 347/102 |

FOREIGN PATENT DOCUMENTS

| | | | |
|---|---|---|---|
| JP | 05-104706 | | 4/1993 |
| JP | 10/086353 | | 4/1998 |
| JP | 11-138793 | | 5/1999 |
| JP | 11-151822 | | 6/1999 |
| JP | 2001-088276 | | 4/2001 |
| WO | 2004/094150 | A1 | 11/2004 |

* cited by examiner

*Primary Examiner*—Matthew Luu
*Assistant Examiner*—Lisa M Solomon
(74) *Attorney, Agent, or Firm*—Workman Nydegger

(57) ABSTRACT

A target transport device includes a transport belt that transports a target from an upstream side to a downstream side, a support member that supports the target transported by the transport belt over the transport belt, a heating unit that heats the support member, and a heat applying unit that applies heat from the heating unit to the support member so that a difference in temperature occurs on a surface of the supporting member supporting the target in a transport direction of the target.

4 Claims, 6 Drawing Sheets

PRINTING APPARATUS, TARGET TRANSPORT DEVICE, AND TARGET TRANSPORT METHOD

BACKGROUND

1. Technical Field

The present invention relates to a printing apparatus such as an ink jet printer, a target transport device provided in the printing apparatus, and a target transport method in the printing apparatus.

2. Related Art

In related art, a serial type ink jet printer has been known as a kind of a printing apparatus performing a printing process on a target. In such a printer, ink is ejected onto a printing medium (target) transported on a platen (support member), from a plurality of nozzles of a printing head (printing unit) mounted on a carriage reciprocating in a direction perpendicular to a transport direction of the printing medium, thereby performing a printing operation. In the printer, the platen supporting the printing medium is heated uniformly by a heater (heating unit) to uniformly fix the ink, which is ejected from the printing head and attached onto the printing medium, to the printing medium.

In addition to the serial type ink jet printer, a line head type ink jet printer has been known as a kind of a printing apparatus performing a printing process on a target. In such a printer, ink is ejected to the printing sheet from a plurality of nozzles formed on a stationary printing head (printing unit), in a state where a printing sheet (target) transported by an endless transport belt wound on three rollers is supported over the transport belt by a platen (support member), thereby performing a printing operation.

JP-A-11-138793 and JP-A-11-151822 are examples of related art.

In the later printer, when the platen is heated uniformly similarly with the case of the former printer, temperature of the transport belt is increased as it becomes closer to the downstream side since the transport belt is heated on the platen and is slid from the upstream side to the downstream side in the transport direction of the printing sheet. That is, even when heat from the platen is applied uniformly to the transport belt, the heat leans to the downstream side of the transport direction of the printing sheet at the time of transporting the printing sheet using the transport belt.

For this reason, a difference in temperature occurs on a surface of the transport belt supporting the printing sheet. Thus, the printing sheet is not sufficiently heated, and the ink may spread and cohere.

SUMMARY

An advantage of some aspects of the invention is to provide a printing apparatus, a target transport device, and a target transport method, in which temperature of a surface of a transport belt supporting a target can be desirably distributed at the time of transporting the target using the transport belt.

According to an aspect of the invention, a target transport device includes: a transport belt that transports a target from an upstream side to a downstream side; a support member that supports the target transported by the transport belt over the transport belt; a heating unit that heats the support member; and a heat applying unit that applies heat from the heating unit to the support member so that a difference in temperature occurs on a surface of the supporting member supporting the target in a transport direction of the target.

Generally, when heat is applied from the heating unit to the transport belt through the support member, heat of the surface of the support member supporting the target is moved by movement of the transport belt at the time of transporting the target using the transport belt. Accordingly, the heat is transmitted from the support member to the transport belt in a leaning state. For this reason, the temperature of the surface of the transport belt supporting the target cannot be desirably distributed. About this point, according to the above-described configuration, heat is from the heating unit to the support member by the heat applying unit so that a difference in temperature considering heat inclination of the support member caused by the movement of the transport belt occurs on the surface of the support member supporting the target, and thus the temperature of the surface of the transport belt supporting the target can be desirably distributed at the time of transporting the target using the transport belt.

In the target transport device, it is preferable that the heat applying unit applies heat from the heating unit to the support member so that an amount of heat applied from the heating unit to an upstream half of the support member in the transport direction of the target is larger than an amount of heat applied from the heating unit to a downstream half of the support member in the transport direction of the target.

Generally, when heat is applied from the heating unit to the transport belt through the support member, heat of the surface of the support member supporting the target is transferred from the upstream side to the downstream side in the transport direction of the target by the movement of the transport belt at the time of transporting the target using the transport belt. For this reason, on the surface of the support member supporting the target, temperature of the downstream side in the transport direction of the target becomes higher than that of the upstream side. Accordingly, also on the surface of the transport belt supporting the target, temperature of the downstream side of in the transport direction of the target becomes higher than that of the upstream side. That is, a difference in temperature occurs on the surface of the transport belt supporting the target at the time of transporting the target using the transport belt. About this point, according to the above-described configuration, heat is applied from the heating unit to the support member so that an amount of heat applied from the heating unit to an upstream half of the support member in the transport direction of the target is larger than an amount of heat applied from the heating unit to a downstream half of the support member in the transport direction of the target. Therefore, it is possible to suppress the difference in temperature on the surface of the transport belt supporting the target at the time of transporting the target using the transport belt.

In the target transport device, it is preferable that the heat applying unit is provided with a control unit that controls the heating unit and a driving unit for driving the transport belt, and the control unit controls the heating unit and the driving unit so that a difference between the amount of heat applied from the heating unit to the downstream half of the support member in the transport direction of the target and the amount of heat applied from the heating unit to the upstream half of the support member in the transport direction of the target becomes larger as a transport speed of the target transported by the transport belt becomes higher.

Generally, when heat is applied from the heating unit to the transport belt through the support member, the amount of heat transferred from the upstream side to the downstream side in the transport direction of the target by the transport belt becomes larger on the surface of the support member supporting the target as a transport speed of the target transported by the transport belt becomes higher. That is, a different in temperature between the upstream side and the downstream side in the transport direction of the target becomes larger as a driving speed of the transport belt driven by the driving unit becomes higher. About this point, according to the invention, the heating unit and the driving unit are controlled by the control unit so that the amount of heat applied from the heating unit to the upstream half of the support member in the transport direction of the target becomes larger than the amount of heat applied from the heating unit to the downstream half of the support member in the transport direction of the target as the transport speed of the target transported by the transport belt becomes higher. For this reason, even when the transport speed of the target transported by the transport belt is changed at the time of transporting the target using the transport belt, the amounts of heat applied from the heating unit to the upstream half and the downstream half of the support member in the transport direction of the target are controlled, thereby reducing the difference in temperature between the upstream side and the downstream side of the transport belt in the transport direction of the target. That is, it is possible to suppress the difference in temperature on the surface of the transport belt supporting the target at the time of transporting the target using the transport belt.

According to another aspect of the invention, a printing apparatus includes: the target transport device configured as described above; and a printing unit that performs a printing process on the target supported by the support member over the transport belt using liquid.

With such a configuration, the difference in temperature of the surface of the transport belt supporting the target is suppressed, thereby warming the target uniformly. Accordingly, it is possible to dry and fix liquid attached to the printing-processed target without irregularity.

In the printing apparatus, it is preferable that the heat applying unit applies heat from the heating unit to the support member at the time of transporting the target using the transport belt so as to suppress a difference in temperature of an area corresponding to at least a range from a printing process start position to a printing process end position of the printing unit on a surface of the transport belt supporting the target in a transport direction of the target.

With such a configuration, it is possible to warm the target substantially uniformly, at least while the printing process is performed on the target. Accordingly, it is possible to reliably dry and fix liquid attached to the target in the course of the printing process without irregularity.

According to still another aspect of the invention, a target transport method includes: heating a support member that supports a target transported from an upstream side to a downstream side by a transport belt over the transport belt; and applying heat to the support member so that a difference in temperature occurs on a surface of the support member supporting the target in a transport direction of the target.

With such a configuration, it is possible to obtain the above-described operation effects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer as a printing apparatus according to an embodiment of the invention will be described with reference to the drawings. In the following description, "front-rear direction", "left-right direction", and "up-down direction" denote a front-rear direction, a left-right direction, and an up-down direction indicated by arrows shown in FIG. 1 and FIG. 2, respectively.

Figure 1:
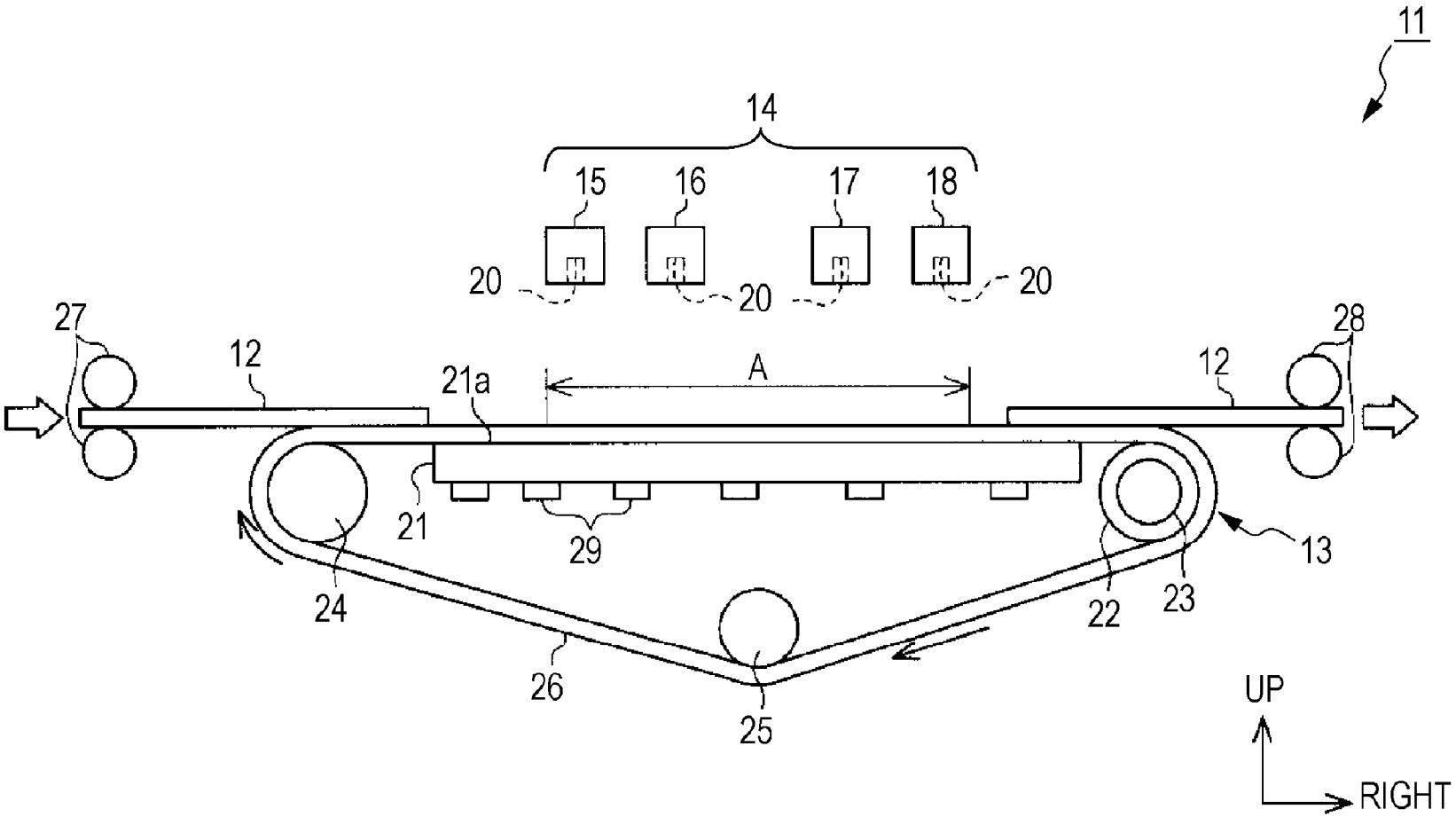
FIG. 1 is a front view of an ink jet printer according to an embodiment.

As shown in FIG. 1, an ink jet printer 11 as a printing apparatus includes a transport unit 13 as a target transport device for transporting a cut sheet 12 as a target, and a printing head unit 14 kept stationary as a printing unit disposed to face the transport unit 13 above the transport unit 13, in a main frame (not shown).

The printing head unit 14 includes a plurality (4 in the embodiment) of printing heads 15 to 18 having a rectangular parallelepiped shape in which a width of each printing head in the front-rear direction is larger than a width of the cut sheet 12. The printing heads 15 to 18 are arranged parallel to the left-right direction in an order of the printing head 15, the printing head 16, the printing head 17, and the printing head 18 from the left side. In the left-right direction, a distance between both printing heads 15 and 16 is the same as a distance between both printing heads 17 and 18, and a distance between both printing heads 16 and 17 is longer than the distance between both printing heads 15 and 16 and the distance between both printing heads 17 and 18.

Figure 2:
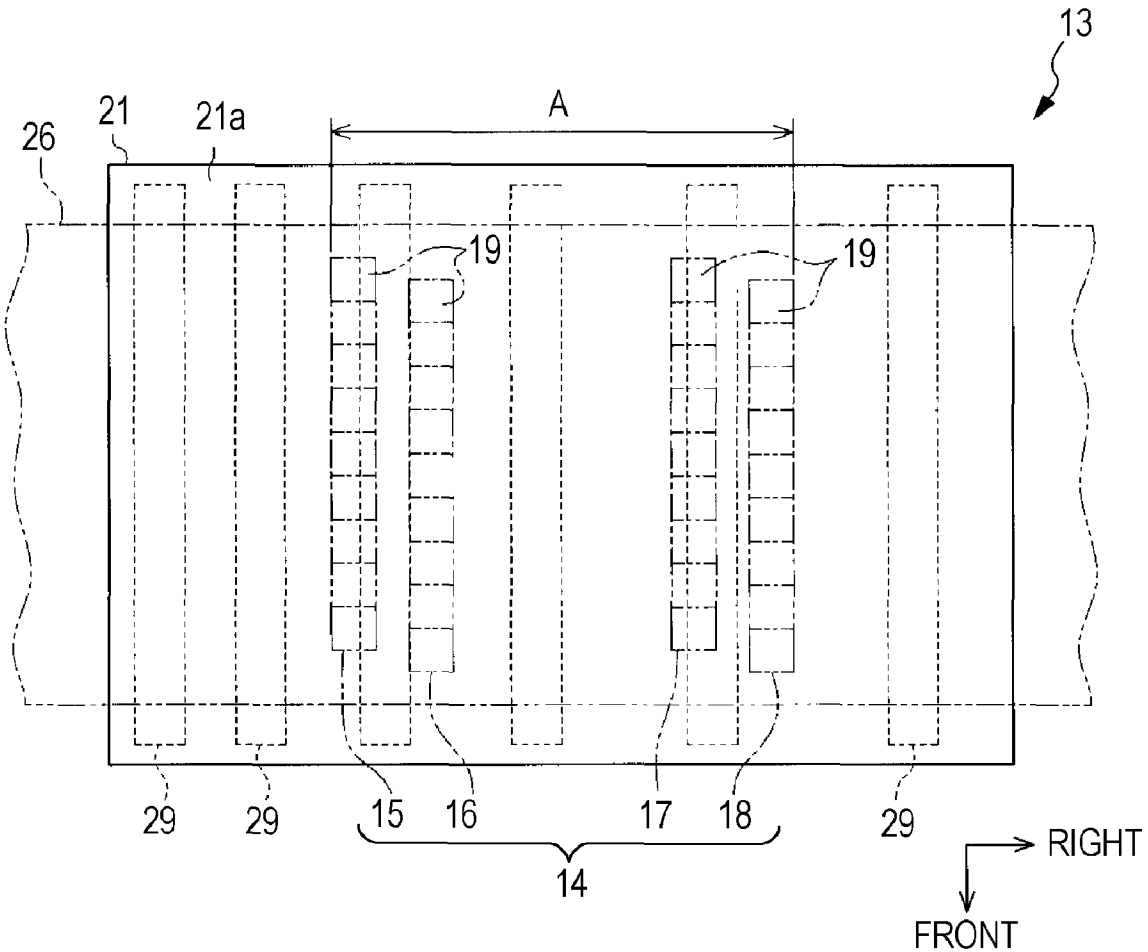
FIG. 2 is a plan view of a transport unit of the printer.

As shown in FIG. 2, each of the printing heads 15 to 18 is integrally formed of a plurality (9 in the embodiment) of unit printing heads 19 in a cube state arranged in a row in the front-rear direction. Both printing heads 16 and 18 are disposed in a state shifted from both printing heads 15 and 17 toward the front side by a half width of the unit printing head 19 in the front-rear direction. That is, the unit printing heads 19 of both printing heads 17 and 18 and the unit printing heads 19 of both printing heads 15 and 16 are arranged in zigzags so that no gap is formed in the left-right direction in which the cut sheet 12 is transported by the transport unit 13.

As shown in FIG. 1 and FIG. 2, each of the unit printing heads 19 of the printing heads 15 to 18 is provided with a plurality of nozzles 20 for ejecting ink as liquid onto the cut sheet 12 transported by the transport unit 13, and the nozzles 20 form rows (form nozzle rows) in the front-rear direction. Different kinds (colors) of ink are supplied from ink cartridges (not shown) to the printing heads 15 to 18. The ink is ejected from the nozzles 20 of the printing heads 15 to 18 onto the cut sheet 12 transported by the transport unit 13, thereby performing a printing operation as a printing process.

As shown in FIG. 1 and FIG. 2, the transport unit 13 is provided with a platen 21 as a supporting member having a rectangular plate shape long in the left-right direction, and a length of the platen 21 in the left-right direction is larger than a distance between a left end of the printing head 15 and a right end of the printing head 18. A driving roller 22 extending in the front-rear direction is provided on the right side of the platen 21 so as to be rotated by a driving motor 23 as a driving unit. On the other hand, a driven roller 24 extending in the front-rear direction is provided on the left side of the platen 21 so as to be rotated. In addition, a tension roller 25 extending in the front-rear direction is provided on the lower side of the flatten 21 so as to be rotated.

One endless transport belt 26 is wound on the driving roller 22, the driven roller 24, and the tension roller 25 to surround the platen 21. In this case, the tension roller 25 is urged downward by a spring member (not shown), and the transport belt 26 is prevented from being loose by applying tension to the transport belt 26.

The driving roller 22 is rotated by the driving motor 23 in a clockwise direction in the front view, thereby circulating (driving) the transport belt 26 along the driving roller 22, the tension roller 25, and the driven roller 24 in the clockwise direction in the front view. In this case, the inside of the transport belt 26 is slid with respect to the upper surface of the platen 21 in a direction from left to right, and the cut sheet 12 on the transport belt 26 is transported from the left side as the upstream side to the right side as the downstream side.

The cut sheet 12 positioned to face the upper surface of the platen 21 is absorbed toward the platen 21 over the transport belt 26 by an absorption unit (not shown). That is, the cut sheet 12 positioned to face the upper surface of the platen 21 is supported over the transport belt 26 by the platen 21. Accordingly, the upper surface of the platen 21 is a support surface 21*a* supporting the cut sheet 12.

As shown in FIG. 1 and FIG. 2, an area corresponding to a range from the left end (printing start position) of the printing head 15 to the right end (printing end position) of the printing head 18 on the surface of the transport belt 26 supporting the cut sheet 12 is a corresponding area A. That is, a printing process of the cut sheet 12 is performed in the corresponding area A.

A pair of upper and lower feeding rollers 27 for feeding a plurality of non-printed cut sheets 12 onto the transport belt 26 one by one are provided on the left upside of the driven roller 24. A pair of upper and lower discharging rollers 28 for discharging the printed cut sheets 12 from the transport belt 26 one by one are provided on the right upside of the driving roller 22.

As shown in FIG. 1 and FIG. 2, a plurality (6 in the embodiment) of heaters 29 as a heating unit having a rectangular sheet shape long in the front-rear direction are attached parallel to each other onto the lower surface of the platen 21 and are arranged along the left-right direction. A power supply (not shown) supplies electric power to the heaters 29, thereby emitting heat from the heaters 29. The heaters are disposed so that intervals between the heaters 29 become gradually larger toward the right side (downstream side of the cut sheet 12 in the transport direction), and the heaters 29 are provided to constitute a heat applying unit.

Accordingly, when the platen 21 is heated by the heaters 29 in a stationary state of the transport belt 26, temperature of the support surface 21*a* of the platen 21 is high on the left side and becomes gradually lower toward the right side (downstream side of the cut sheet 12 in the transport direction). That is, the amount of heat applied from the heaters 29 to the platen 21 on the right half side of the platen 21 is larger than that on the left half side.

Figure 3:
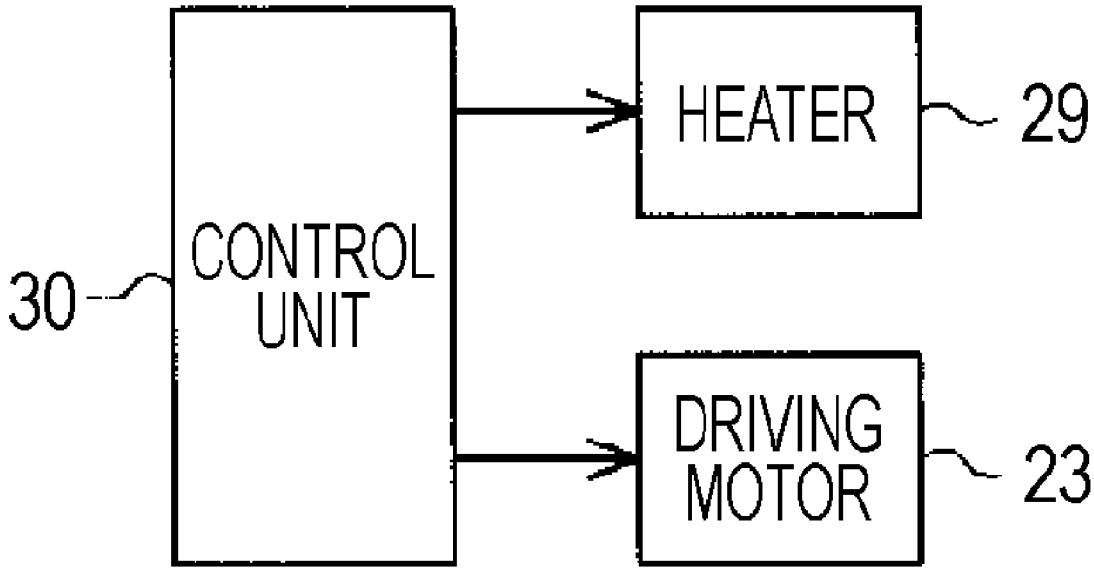
FIG. 3 is a block diagram illustrating an electrical configuration of the printer.

As shown in FIG. 3, a control unit 30 for controlling an operation state of the ink jet printer 11 is provided in the main frame (not shown) of the ink jet printer 11 (see FIG. 1). The control unit 30 is electrically connected to the driving motor 23 and the heaters 29, and controls a driving state of the driving motor 23 and an electrical state of the heaters 29.

Next, an operation of the ink jet printer 11 will be described.

When a printing operation is performed on the cut sheet 12, electric power is applied to the heaters 29 on the basis of signals output from the control unit 30, thereby emitting heat from the heaters 29. The platen 21 is heated by the heat of the heaters 29 (heating step). In this case, since the heaters 29 are disposed so that the intervals between the heaters 29 become gradually larger toward the right side, the temperature of the support surface 21*a* of the platen 21 becomes gradually lower toward the right side (heat applying step).

Subsequently, the driving motor 23 is driven on the basis of a signal output from the control unit 30, the transport belt 26 is driven in a constant speed through the driving roller 22. In this case, since the transport belt 26 is slid from the left side to the right side on the support surface 21*a* of the platen 21, the transport belt 26 is warmed on the support surface 21*a* by the heat of the support surface 21*a*. However, the warmed transport belt 26 emits heat while passing through the support surface 21*a* of the platen 21 and sequentially moving through the driving roller 22, the tension roller 25, and the driven roller 24. Accordingly, the transport belt 26 is cooled at the time of reaching the left end of the support surface 21*a* of the platen 21.

For this reason, the transport belt 26 is slid from the left side to the right side on the support surface 21*a* while the transport belt 26 is warmed by taking much heat from the left end of the support surface 21*a* of the platen 21. Since the transport belt 26 is slid from the left side to the right side on the support surface 21*a* while the transport belt 26 is warmed gradually, the amount of the heat taken from the support surface 21*a* becomes less toward the right side on the support surface 21*a*.

That is, the heat on the left side higher in temperature than the right side of the support surface 21*a* of the platen 21 in the stationary state of the transport belt 26 is transferred to the right side lower in temperature than the left side of the support surface 21*a* of the platen 21 by the transport belt 26 in the driving state of the transport belt 26. For this reason, a difference in temperature between the left side and the right side of the support surface 21*a* of the platen 21 becomes small, and a difference in temperature of the whole support surface 21*a* is suppressed.

The transport belt 26 obtains heat from the support surface 21*a* of the platen 21 in which the difference in temperature is suppressed, thereby substantially uniformly warming the support surface 21*a*. That is, the temperature of the surface of the transport belt 26 supporting the cut sheet 12 on the support surface 21*a* of the platen 21 becomes substantially uniform.

In this state, when the cut sheet 12 is fed from the upstream side (left side) on the transport belt 26 by the feeding rollers 27, the cut sheet 12 is transported toward the downstream side (right side) by the substantially uniformly warmed transport belt 26. While the cut sheet 12 is transported by the transport belt 26, ink is sequentially ejected from the nozzles 20 of the printing heads 15 to 18 onto the cut sheet 12, thereby performing a printing operation.

At this time, since the temperature of the surface of the transport belt 26 supporting the cut sheet 12 is substantially uniform, the cut sheet 12 is substantially uniformly warmed by the heat of the transport belt 26. For this reason, the ink ejected from the nozzles 20 of the printing heads 15 to 18 and attached to the cut sheet 12 is appropriately dried and fixed without irregularity, and thus spread of the ink caused by drying irregularity of ink is suppressed, thereby improving print quality of the cut sheet 12. Then, the cut sheet 12 is discharged from the transport belt 26 by the discharging rollers 28.

In the stationary state of the transport belt 26, when the platen 21 is heated so that the temperature of the support surface 21*a* of the platen 21 becomes substantially uniform, the heat of the support surface 21*a* of the platen 21 is transferred from the left side to the right side by the transport belt 26 at the time of driving the transport belt 26. For this reason, the temperature of the support surface 21*a* of the platen 21 is low on the left side and is high on the right side. Accordingly, the temperature of the transport belt 26 on the support surface 21*a* is low on the left side and is high on the right side. As a result, when a printing operation is performed on the cut sheet 12 transported by the transport belt 26, drying irregularity occurs on the printed cut sheet 12. Therefore, the ink spreads, and thus print quality decreases.

According to the above-described embodiment, the following advantages can be obtained.

(1) Generally, when heat is applied from the heaters 29 to the transport belt 26 through the platen 21, heat of the support surface 21*a* of the platen 21 is transferred from the upstream side (left side) to the downstream side (right side) in the transport direction of the cut sheet 12 by the movement of the transport belt 26 at the time of transporting the cut sheet 12 using the transport belt 26. For this reason, on the support surface 21*a* of the platen 21, the temperature of the right side becomes higher than that of the left side. Accordingly, also on the surface of the transport belt 26 supporting the cut sheet 12 on the support surface 21*a*, the temperature of the right side becomes higher than that of the left side. That is, a difference in temperature occurs on the surface of the transport belt 26 supporting the cut sheet 12 on the support surface 21*a* of the platen 21 at the time of transporting the cut sheet 12 using the transport belt 26.

About this point, according to the embodiment, heat is applied from the heaters 29 to the platen 21 so that the amount of heat applied from the heaters 29 to the left half of the platen 21 is larger than the amount of heat applied from the heaters 29 to the right half of the platen 21. Therefore, it is possible to suppress the difference in temperature on the surface of the transport belt 26 supporting the cut sheet 12 at the time of transporting the cut sheet 12 using the transport belt 26. Accordingly, it is possible to sufficiently warm the cut sheet 12 substantially uniformly, and thus it is possible to dry and fix the ink ejected from the nozzles 20 of the printing heads 15 to 18 and attached to the cut sheet 12 without irregularity. As a result, spread or cohesion of ink caused by drying irregularity of ink is suppressed from occurring, and thus it is possible to improve print quality of the cut sheet 12.

(2) Heat is applied from the heaters 29 to the platen 21 so as to suppress the difference in temperature of at least the corresponding area A of the transport belt 26 where the printing operation is performed on the cut sheet 12 at the time of transporting the cut sheet 12 using the transport belt 26, and thus it is possible to substantially uniformly warm the cut sheet 12 at least while the printing operation is performed on the cut sheet 12. Accordingly, it is possible to reliably dry and fix the ink attached to the cut sheet 12 in the course of the printing operation without irregularity.

Modified Example

The embodiment may be modified as follows.

Figure 4:
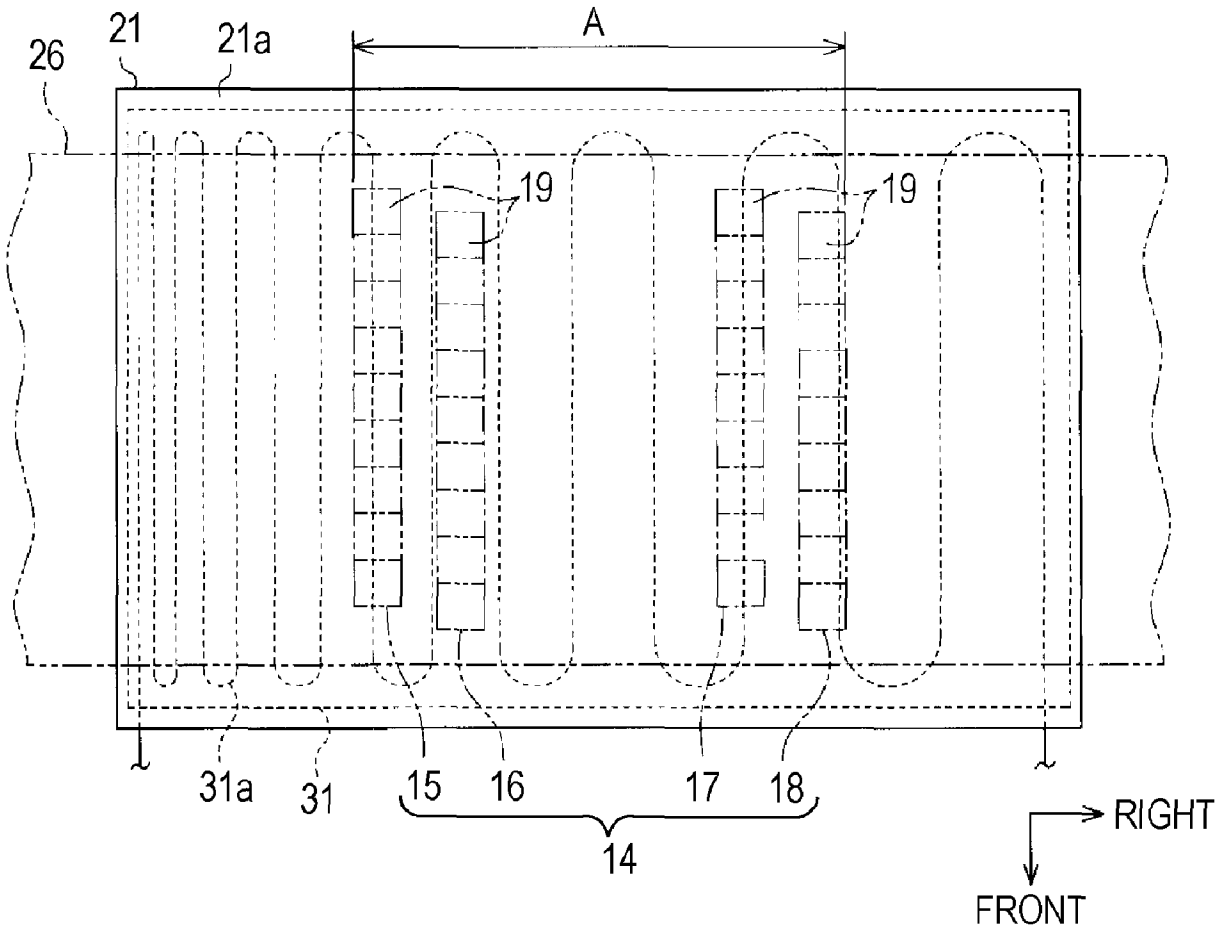
FIG. 4 is a plan view of a transport unit of an ink jet printer according to a modified example.

As shown in FIG. 4, the six heaters 29 may be modified into one rectangular sheet-shaped heater 31 attached to cover the substantially whole lower surface of the platen 21, and a patterning process may be performed so that density of a heating wire 31*a* of the heater 31 becomes gradually lower from the left side toward the right side of the platen 21. With such a configuration, it is possible to reduce the number of components, and it is possible to apply heat to the platen 21 so that the temperature of the support surface 21*a* of the platen becomes gradually lower from the left side to the right side in the stationary state of the transport belt 26. In this case, the heater 31 may be embedded in the platen 21.

Figure 5:
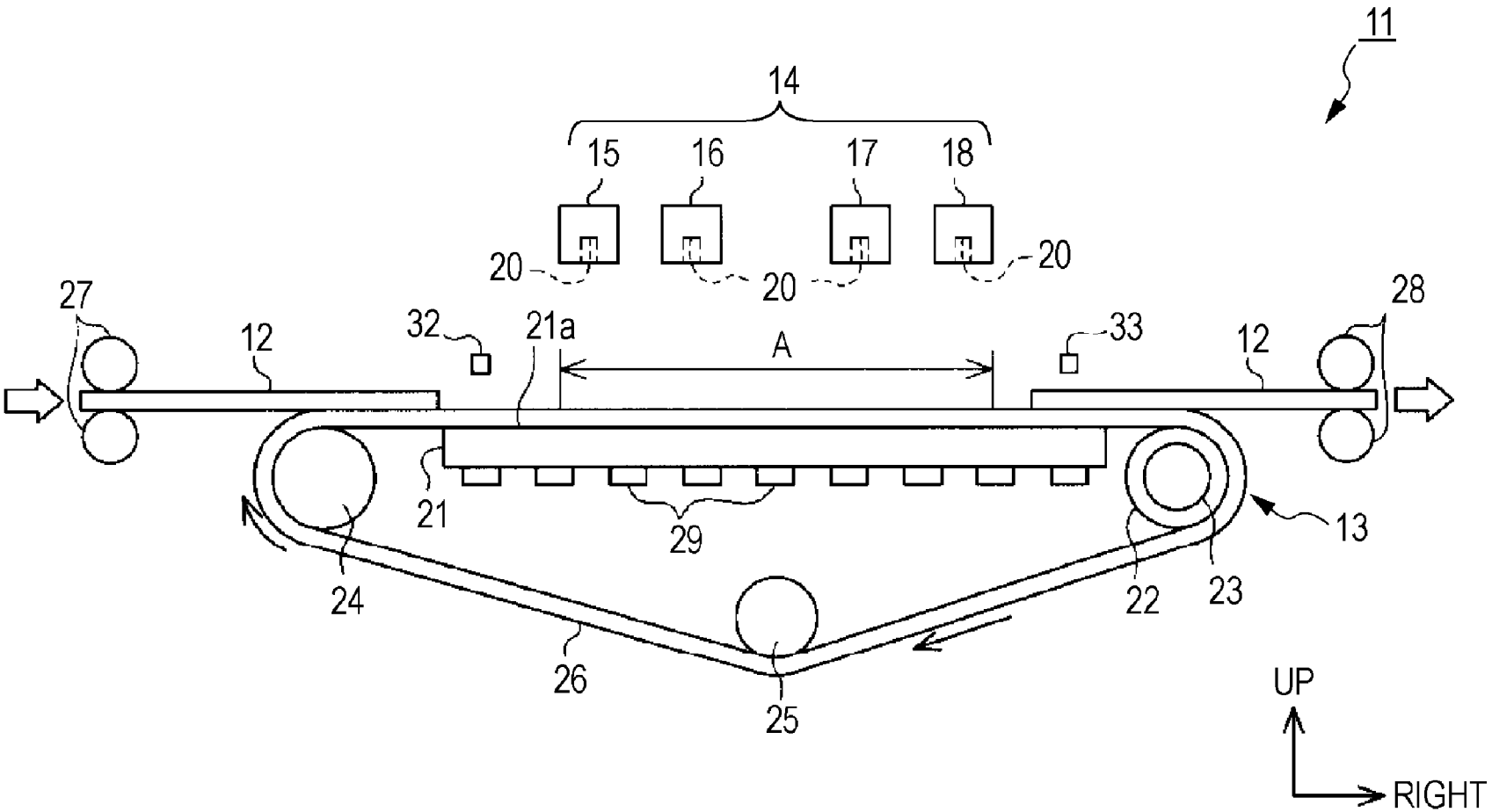
FIG. 5 is a front view of the ink jet printer according to the modified example.
Figure 6:
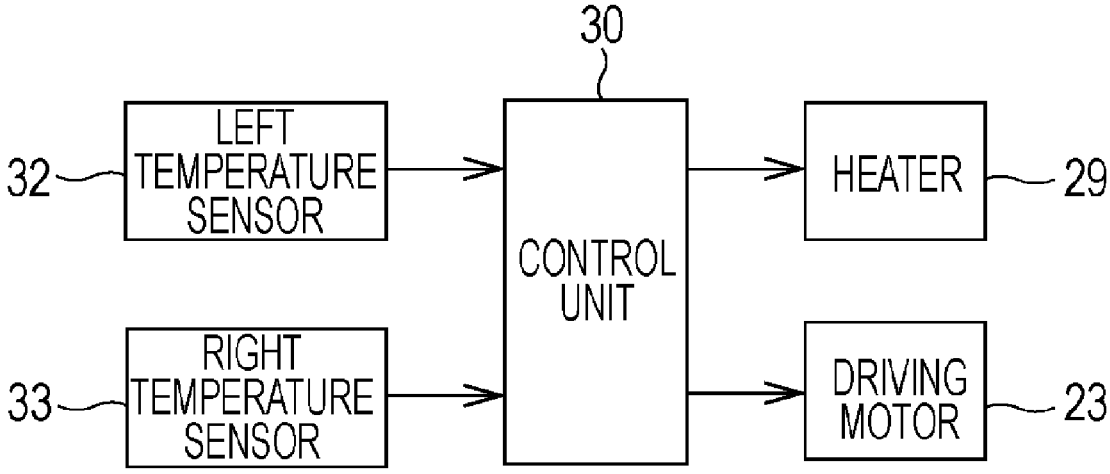
FIG. 6 is a block diagram illustrating an electrical configuration of the printer.

As shown in FIG. 5 and FIG. 6, a plurality (9 in this example) of heaters 29 are arranged with the same interval in the left-right direction, and there are provided a left temperature sensor 32 and a right temperature sensor 33 for detecting temperature at a left end and a right end of the surface of the transport belt 26 supporting the cut sheet 12 on the platen 21. The left temperature sensor 32 and the right temperature sensor 33 are electrically connected to the control unit 30, and the control unit 30 may be configured to control output values of the heaters 29 and a driving speed of the driving motor 23 so as to reduce a difference between temperature detected by the left temperature sensor 32 and temperature detected by the right temperature sensor 33. That is, the output values of the heaters 29 are set to gradually decrease from the left side toward the right side, and the control unit 30 may be configured to control the output values of the heaters 29 and the driving speed of the driving motor 23 so that a difference of output values between the heaters 29 becomes larger as the driving speed (speed of the cut sheet 12 transported by the transport belt 26) of the driving motor 23 becomes higher.

Generally, when heat is applied from the heaters 29 to the transport belt 26 through the platen 21, the amount of heat transferred from the left side toward the right side on the support surface 21*a* of the plate 21 by the transport belt 26 becomes larger as the transport speed of the cut sheet 12 transported by the transport belt 26 becomes higher. That is, as the driving speed of the transport belt 26 driven by the driving motor 23 becomes higher, the difference in temperature between the left side and the right side on the support surface 21*a* of the platen 21 becomes larger.

About this point, according to the above-described configuration, the output values of the heaters 29 and the driving speed of the driving motor 23 are controlled by the control unit 30 so that the amount of heat applied from the heaters 29 to the left half of the platen 21 becomes lager than the amount of heat applied from the heaters 29 to the right half of the platen 21 as the transport speed of the cut sheet 12 transported by the transport belt 26 becomes higher. For this reason, even when the transport speed of the cut sheet 12 transported by the transport belt 26 is changed at the time of transporting the cut sheet 12 using the transport belt 26, the amounts of heat applied from the heaters 29 to the left half and the right half of the platen 21 are controlled.

That is, the control unit 30 controls the output values of the heaters 29 and the driving speed of the driving motor 23 so that the amount of heat applied from the heaters 29 to the left half of the platen 21 becomes larger than the amount of heat applied from the heaters 29 to the right half of the platen 21, as much as the amount of heat of the support surface 21*a* of the platen 21 transferred from the left side to the right side by the transport belt 26. Accordingly, it is possible to reduce the difference in temperature between the left side and the right side of the transport belt 26 on the support surface 21*a* of the platen 21 at the time of the transporting the cut sheet 12 transported by the transport belt 26, and thus it is possible to suppress the difference in temperature of the surface of the transport belt 26 supporting the cut sheet 12.

In this case, in the viewpoint of uniformly warming the cut sheet 12, it is ideal that the difference in temperature between the left end (value measured by the left temperature sensor 32) and the right end (value measured by the right temperature sensor 33) of the surface of the transport belt 26 supporting the cut sheet 12 is 0. However, the difference in temperature may fall within a predetermined range (range of a value which can be previously obtained by an experiment or the like) of securing print quality of the cut sheet 12.

If the total amount of heat applied to the left half of the platen 12 is larger than the total amount of heat applied to the right half of the platen 21, the output values of the heaters 29 need not necessarily become gradually smaller from the left side toward the right side.

The amount of heat applied from the heaters 29 to the right half of the platen 21 may be larger than the amount of heat applied from the heaters 29 to the left half of the platen 21.

The positions, the quantities, and the output values of the heaters 29 may be appropriately modified according to specifications of the ink jet printer 11. For example, when the positions, the quantities, and the output values of the heaters 29 are modified so that the amount of heat applied to the right end of the platen 21 becomes larger than the amount of heat applied to a part except the right end of the platen 21, the temperature of the right end of the transport belt 26 supporting the cut sheet 12 on the support surface 21*a* of the platen 21 becomes higher than the other part. Accordingly, it is possible to improve a drying property of the cut sheet 12 after printing. As described above, the temperature of the surface of the transport belt 26 supporting the cut sheet 12 can be desirably distributed at the time of transporting the cut sheet 12 using the transport belt 26 by appropriately modifying the positions, the quantities, and the output values of the heaters 29.

The heaters 29 may be embedded in the platen 21.

In the above-described embodiment, the printing apparatus is embodied by the ink jet printer 11, but may be embodied by a liquid ejecting apparatus that ejects liquid (including liquefied materials formed by dispersing or mixing functional material particles with liquid, and fluid materials such as gel) other than ink. In the specification, "liquid" includes, for example, liquefied materials, fluid materials, and the like, in addition to inorganic solvent, organic solvent, solution, liquefied resin, liquefied metal (metal melt), and the like.

What is claimed is:

1. A target transport device comprising:

a transport belt that transports a target from an upstream side to a downstream side;

a support member that supports the target transported by the transport belt over the transport belt;

a heating unit that heats the support member; and a heat applying unit that applies heat from the heating unit to the support member so that a difference in temperature occurs on a surface of the supporting member supporting the target in a transport direction of the target, wherein the heat applying unit applies heat from the heating unit to the support member so that an amount of heat applied from the heating unit to an upstream half of the support member in the transport direction of the target is larger than an amount of heat applied from the heating unit to a downstream half of the support member in the transport direction of the target, wherein the heat applying unit is provided with a control unit that controls the heating unit and a driving unit for driving the transport belt, and wherein the control unit controls the heating unit and the driving unit so that a difference between the amount of heat applied from the heating unit to the downstream half of the support member in the transport direction of the target and the amount of heat applied from the heating unit to the upstream half of the support member in the transport direction of the target becomes larger as a transport speed of the target transported by the transport belt becomes higher.

2. A printing apparatus comprising:

the target transport device according to claim 1; and a printing unit that performs a printing process on the target supported by the support member over the transport belt using liquid.

3. The printing apparatus according to claim 2, wherein the heat applying unit applies heat from the heating unit to the support member at the time of transporting the target using the transport belt so as to suppress a difference in temperature of an area corresponding to at least a range from a printing process start position to a printing process end position of the printing unit on a surface of the transport belt supporting the target in a transport direction of the target.

4. A target transport method comprising:

heating a support member that supports a target transported from an upstream side to a downstream side by a transport belt over the transport belt; and applying heat to the support member so that a difference in temperature occurs on a surface of the support member supporting the target in a transport direction of the target, wherein the heat is applied by a heat applying unit which applies heat from a heating unit to the support member so that an amount of heat applied from the heating unit to an upstream half of the support member in the transport direction of the target is larger than an amount of heat applied from the heating unit to a downstream half of the support member in the transport direction of the target, wherein the heat applying unit is provided with a control unit that controls the heating unit and a driving unit for driving the transport belt, and wherein the control unit controls the heating unit and the driving unit so that a difference between the amount of heat applied from the heating unit to the downstream half of the support member in the transport direction of the target and the amount of heat applied from the heating unit to the upstream half of the support member in the transport direction of the target becomes larger as a transport speed of the target transported by the transport belt becomes higher.

* * * * *